US010188198B1

(12) United States Patent
Weber

(10) Patent No.: US 10,188,198 B1
(45) Date of Patent: Jan. 29, 2019

(54) FINGER RETENTION CLIP

(71) Applicant: Timothy B. Weber, Andover, MN (US)

(72) Inventor: Timothy B. Weber, Andover, MN (US)

( * ) Notice: Subject to any disclaimer, the term of this patent is extended or adjusted under 35 U.S.C. 154(b) by 0 days.

(21) Appl. No.: 15/662,397

(22) Filed: Jul. 28, 2017

(51) Int. Cl.
*A45F 5/00* (2006.01)
*F21V 17/10* (2006.01)
*F21V 21/08* (2006.01)
*F21V 23/04* (2006.01)

(52) U.S. Cl.
CPC ..... *A45F 5/00* (2013.01); *F21V 17/10* (2013.01); *F21V 21/08* (2013.01); *F21V 23/0421* (2013.01); *A45F 2005/008* (2013.01)

(58) Field of Classification Search
CPC ... A45F 2005/008; A45F 5/00; B43K 23/012; A42F 13/22
USPC ..... 224/217; D14/427
See application file for complete search history.

(56) References Cited

U.S. PATENT DOCUMENTS 503,011 A * 8/1893 Stathem ..... B43K 23/012 131/258
1,462,714 A * 7/1923 Marchand ..... B43K 23/001 131/258
2,072,851 A * 3/1937 Bailey ..... A24F 13/22 131/258
2,084,343 A * 6/1937 Jefferis ..... A24F 13/22 131/258
3,263,444 A * 8/1966 Di Croce ..... A44C 9/0038 24/303
3,596,964 A * 8/1971 Zazzara ..... B43K 23/012 224/217
3,666,372 A * 5/1972 Lipkowski ..... B43L 15/00 224/217
4,084,692 A * 4/1978 Bilweis ..... A61B 17/06123 206/403
5,732,862 A * 3/1998 Bull ..... A61C 19/006 206/63.5
6,082,997 A * 7/2000 Prescott ..... A61C 19/006 224/217
6,164,965 A * 12/2000 Hammerlund ..... A61C 19/006 224/217
6,280,189 B1 * 8/2001 Muller ..... A61C 19/006 224/217
6,905,271 B1 * 6/2005 Short ..... B43K 23/012 401/48
8,196,787 B2 * 6/2012 Strandberg ..... A45F 5/00 2/16

* cited by examiner

*Primary Examiner* — Justin Larson
(74) *Attorney, Agent, or Firm* — James E. Walton

(57) ABSTRACT

A finger retention clip for retaining an object about a user's finger includes a tubular base member adapted for attachment to the object and a resilient retaining member attached to the base member, the retaining member forming an open finger loop and being sized and shaped to conform to the user's finger, wherein the retaining member is configured, such that the retaining member releases from the user's finger in response to a selected force.

10 Claims, 4 Drawing Sheets

FINGER RETENTION CLIP

BACKGROUND

1. Field of the Invention

The present application relates generally to retention clips for holding small devices.

2. Description of Related Art

There are many different types of lanyards and retentions clips for holding small objects, such as keys, tools, writing implements, and the like. These retention devices usually have straps and/or clips for retaining and storing the objects in close proximity to the user, so that the user can quickly and easily grab the object, use it, and return it to its storage position.

Although great strides have been made in the area of retention clips for holding small devices, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1B:
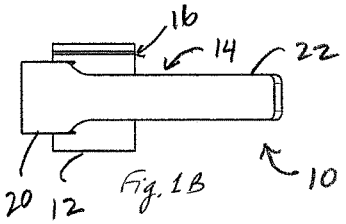
FIGS. 1B-1D are orthographic views of the finger retention clip of FIG. 1A.
Figure 1A:
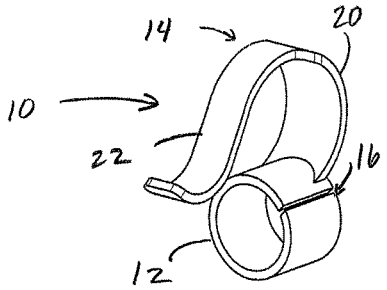
FIG. 1A is a perspective view of a first embodiment of a finger retention clip according to the present application.
Figure 1C:
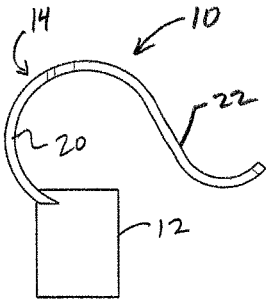
Figure 1D:
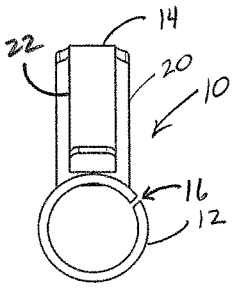
Figure 2B:
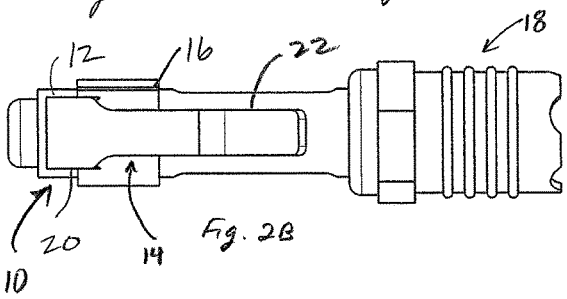
FIGS. 2B-2D are orthographic views of the finger retention clip and flashlight of FIG. 2A.
Figure 2A:
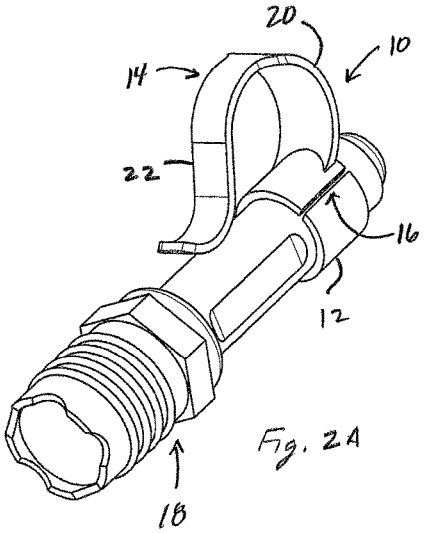
FIG. 2A is a perspective view of the finger retention clip of FIGS. 1A-1D shown attached to a flashlight.
Figure 2C:
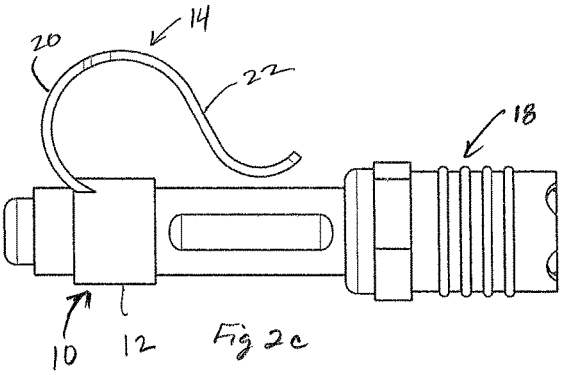
Figure 2D:
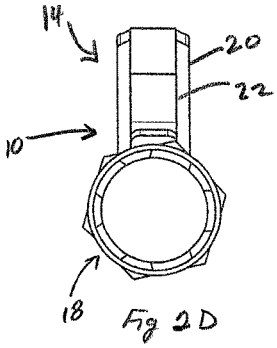
Figure 3B:
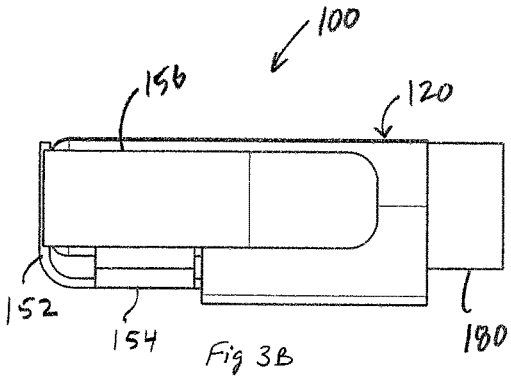
FIGS. 3B-3D are orthographic views of the finger retention clip of FIG. 3A.
Figure 3A:
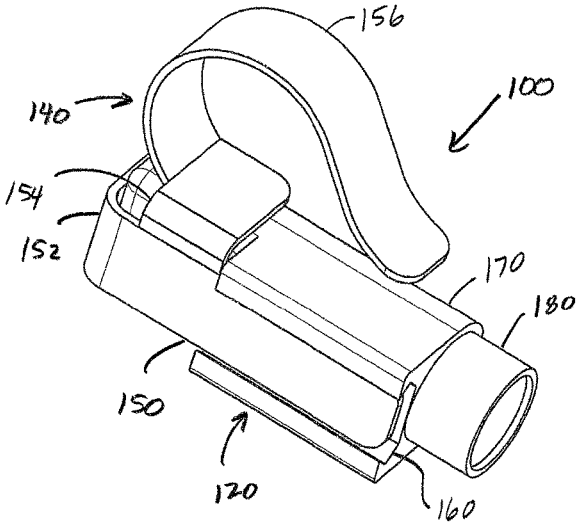
FIG. 3A is a perspective view of an alternative embodiment of a finger retention clip according to the present application shown attached to a flashlight.
Figure 3C:
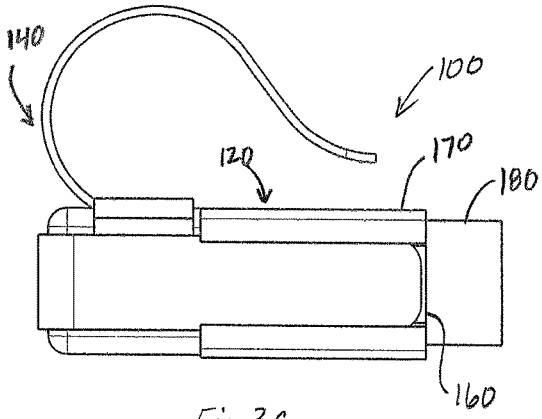
Figure 3D:
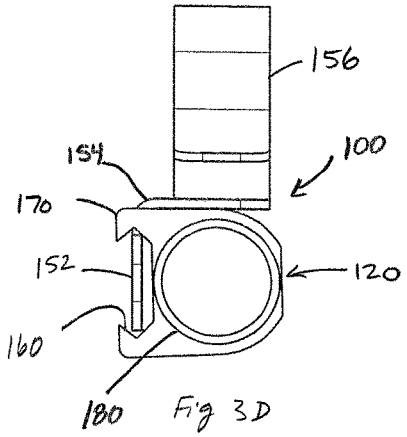
Figure 4B:
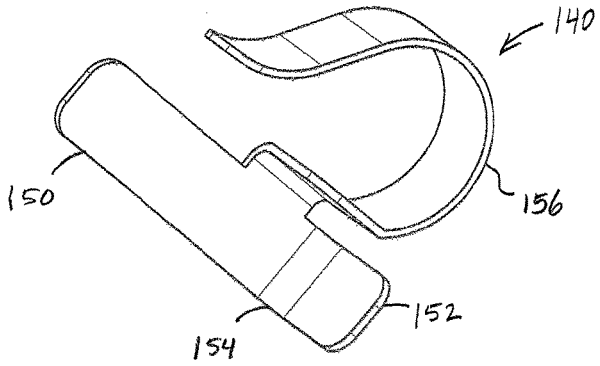
FIGS. 4A and 4B are perspective views of the retaining member of the finger retention clip of FIGS. 3A-3D.
Figure 4A:
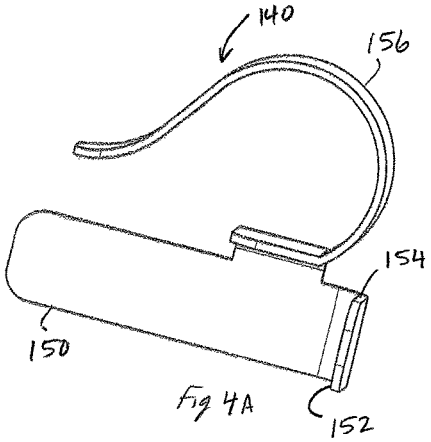
Figure 4C:
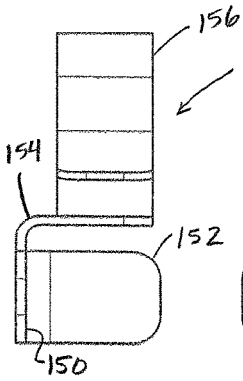
FIGS. 4C-4F are orthographic views of the retaining member of FIGS. 4A and 4B.
Figure 4D:
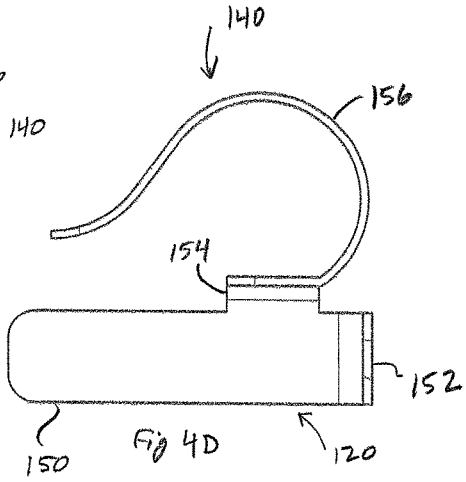
Figure 4E:
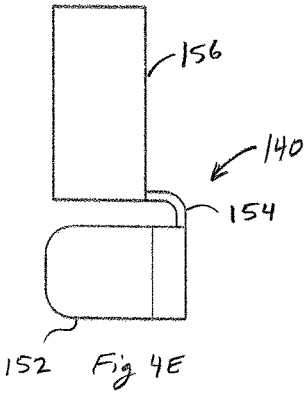
Figure 4F:
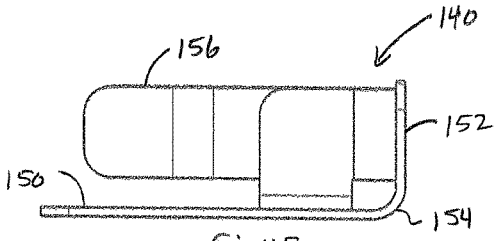

While the assembly and method of the present application is susceptible to various modifications and alternative forms, specific embodiments thereof have been shown by way of example in the drawings and are herein described in detail. It should be understood, however, that the description herein of specific embodiments is not intended to limit the present application to the particular embodiment disclosed, but on the contrary, the intention is to cover all modifications, equivalents, alternatives, and combinations thereof, falling within the spirit and scope of the present application as defined by the appended claims.

DETAILED DESCRIPTION OF THE PREFERRED EMBODIMENT

The finger retention clips of the present application allow the user to hold and use the objects with one hand, while still being able to use that hand to perform other tasks, such as using tools, climbing ladders, using weapons, etc. The finger retention clips of the present application include large, open-loop retaining members that perform multiple functions, including: retaining the clip securely to the user's finger or fingers; allowing the user to store the finger retention clip on a belt or pocket; allowing the user to quickly get the finger retention clip onto his finger by simply inserting his finger or fingers through the clip member while the finger retention clip is being stored on a belt or pocket; and allowing the user to rotate the clip member about his finger or fingers to quickly move the object from the palm side of his hand to the back side of his hand, and vice versa. One important feature of the finger retention clips of the present application is that the clips are selectively tailored and configured to provide a safe and effective "tear-away" feature, so that the user is not harmed if the object is pulled away from the user's finger.

It will be appreciated that while the finger retention clips of the present application are shown and described herein as being releasably attached to flashlights, the finger retention clips of the present application may be releasably attached to a wide variety of objects and tools. In addition, while the finger retention clips of the present application are described herein as being retrofit onto existing flashlights, it will be appreciated that the finger retention clips of the present application may be easily made as integral components of the objects.

Referring to FIGS. 1A-1D and 2A-2D in the drawings, a finger retention clip 10 according to a first embodiment of the present application is illustrated. Clip 10 includes a base member 12 and a retaining member 14. Base member 12 and retaining member 14 are preferably made of the same semi-rigid material, such as plastic, nylon, or rubber; however, it will be appreciated that base member 12 and retaining member 14 may be made of different types of material, and that portions of base member 12 and retaining member 14 may also be made of various materials. For example, base member 12 and/or retaining member 14 may include one or more moisture-resistant layers, surface treatments, coatings, various anti-slip features, decorative components, and/or defensive components.

As is shown, base member 12 includes a slot 16 that makes an open loop out of base member 12. Slot 16 allows base member 12 to be stretched apart, so that base member 12 may be installed around an object, such as flashlight 18. Because base member 12 is formed of a semi-rigid, resilient material, base member 12 fits snuggly around flashlight 18, but may be quickly and easily released from flashlight 18, if desired. In some embodiments, it may desirable for base member 12 to be permanently, or semi-permanently, affixed to flashlight 18. In such cases, a layer of adhesive or other bonding material may be applied between base member 12 and flashlight 18. In addition, base member 12 may be attached to flashlight 18 with milled mounting screws, bolts, or other threaded or twist-lock fasteners.

Retaining member 14 preferably includes a neck portion 20 that is attached to base member 12 and extends outward from base member 12. Neck portion 20 transitions into a thinner tab portion 22 that curves back toward base member 12. Neck portion 20 and tab portion 22 form a large open finger loop, preferably large enough for a user's finger to pass through. Tab portion 22 may curve back outward away from base member 12 to facilitate the placement of clip 10 onto a belt or into a pocket. Because retaining member 14 is formed of a semi-rigid, resilient material, retaining member 14 clamps against flashlight 18 and holds clip 10 securely against a belt or pocket. Retaining member 14 may be used to releasably attach clip 10 to other objects, such as straps, ladders, tools, backpacks, etc. Tab portion 22 may be configured to be in contact with flashlight 18, i.e., pressing against flashlight 18 with a tailored preload, or merely in close proximity. It will be appreciated that in some applications it will be desirable that tab portion 22 be wider than neck portion 20.

Clip 10 includes a unique tear-away feature, in that clip 10 will break or otherwise release from the user's finger without harming the user in the event clip 10 (or the object to which clip 10 is attached) becomes snagged on an obstruction, or is otherwise pulled or twisted away. For example, the user may be a law enforcement officer and flashlight 18 may get pulled away in a scuffle with a perpetrator; or the user may be a hunter and flashlight 18 may get snagged on a ladder or a tree branch. This tear-away feature can be accomplished in a variety of ways. Clip 10 can be custom tailored to ensure that clip 10 yields, or otherwise releases from the user's finger in a predesigned fashion in response to certain tension or torsion forces. For example: base member 12 can break, base member 12 can twist off of the object, neck portion 20 can break, tab portion 22 can break, the connection between neck portion 20 and base member 12 can break, and retaining member 14 can twist off of the user's finger. It will be appreciated that clip 10 may include notches and other structural features that selectively provide stress concentrations, which facilitate the yielding of clip 10 when subjected to certain forces.

Referring now also to FIGS. 3A-3D and 4A-4F in the drawings, a finger retention clip 100 according to an alternative embodiment of the present application is illustrated. Clip 100 is a two-piece assembly having a base member 120 and a retaining member 140. Base member 120 and retaining member 140 are preferably made of the same semi-rigid material, such as plastic, nylon, or rubber; however, it will be appreciated that base member 120 and retaining member 140 may be made of different types of material, and that portions of base member 120 and retaining member 140 may also be made of various materials. For example, base member 120 and/or retaining member 140 may include one or more moisture-resistant layers, surface treatments, coatings, various anti-slip features, decorative components, and/or defensive components.

As is shown, base member 120 includes a rigid tubular connector 170 and at least one elongated receiver channel 160. Base member 120 is configured to allow base member 120 to be installed around an object, such as a flashlight 180. Because base member 120 is formed of a semi-rigid, resilient material, tubular member 170 fits snuggly around flashlight 180, but may be quickly and easily released from flashlight 180, if desired. Tubular connector 170 may also be made from a non-rigid material, including resilient tubular material (such as nylon, silicone, rubber, and/or plastic), adjustable straps, hook and loop tape, and various combinations of such types of materials. In some embodiments, it may desirable for base member 120 to be permanently, or semi-permanently, affixed to flashlight 180. In such cases, a layer of adhesive or other bonding material may be applied between tubular member 170 and flashlight 180. In addition, base member 120 may be attached to flashlight 180 with milled mounting screws, bolts, or other threaded or twist-lock fasteners.

Retaining member 140 preferably includes an elongated slider tab 150, a stop tab 152, a neck portion 154 located between slider tab 150 and stop tab 152, and a loop member 156. Neck portion 154 forms a transition between slider tab 152 and loop member 156. Loop member 156 forms a large open loop, preferably large enough for a user's finger to pass through. Loop member 156 may curve back outward away from slider tab 150 to facilitate the placement of clip 100 onto a belt or into a pocket. Because loop member 156 is formed of a semi-rigid, resilient material, loop member 156 is biased toward flashlight 180 and holds clip 100 securely against a belt or pocket. It will be appreciated that loop member 156 may be used to releasably attach clip 100 to other objects, such as ladders, tools, backpacks, etc. Loop member 156 may be configured to be in contact with flashlight 180, i.e., pressing against flashlight 180 with a tailored preload, or merely in close proximity.

Receiver channel 160 is preferably shaped and dimensioned to matingly receive slider tab 150. This allows retaining member 140 to be snuggly held in place by receiver channel 160, while allowing quick and easy removal of retaining member 140 from base member 120. Slider tab 150 and receiver channel 160 are also shaped and dimensioned to be received by conventional weapon mounting platforms and tactical gun rails, such as Picatinny™ rails. This allows flashlight 180 to be quickly and easily interchanged between hand-held use and use with a weapon having conventional attachment rails. Thus, it will be appreciated that retaining member 140 may be used with any device, such as flashlights, scopes, range finders, laser pointers, couplings, and/or adapters, having conventional attachment rails. By attaching retaining member 140 to these devices, the user can use these devices in a hand-held manner and also store them for quick and easy removal from a belt or pocket. Slider tab 150 may have the same cross-sectional shape as receiver channel 160.

Receiver channel 160 may include mounting apertures through which threaded mounting screws or unthreaded fasteners may pass for securing slider tab 150 to receiver channel 160 and/or for securing receiver channel 160 to a tactical rail system. It will be appreciated that tubular connector 170 may include multiple receiver channels 160. This also allows tubular connector 170 and flashlight 180 to be mounted to a tactical rail system via one receiver channel 160, while being coupled to slider tab 150 via another receiver channel 160.

As with clip 10, clip 100 includes a unique tear-away feature, in that clip 100 will break or otherwise release from the user's finger without harming the user in the event clip 100 (or the object to which clip 100 is attached) becomes snagged on an obstruction, or is otherwise pulled or twisted away. For example, the user may be a law enforcement officer and flashlight 180 may get pulled away in a scuffle with a perpetrator; or the user may be a hunter and flashlight 180 may get snagged on a ladder or a tree branch. This tear-away feature can be accomplished in a variety of ways. Clip 100 can be custom tailored to ensure that clip 100 yields, or otherwise releases from the user's finger in a predesigned fashion in response to certain tension or torsion forces. For example: slider tab 150 can break, slider tab 150 release from receiver channel 160, neck portion 154 can break, loop member 156, and loop member 156 can twist off of the user's finger.

Although retaining member 14 and loop member 156 have been shown as forming only a single loop shaped and dimensioned to fit a single finger, it should be understood that retaining member 14 and loop member 156 may be shaped to accommodate two or more fingers. In addition, although base members 12 and 120 have been shown having circular cross-sections, it should be understood that base members 12 and 120 may have any desirable cross-sectional shape.

Figure 5:
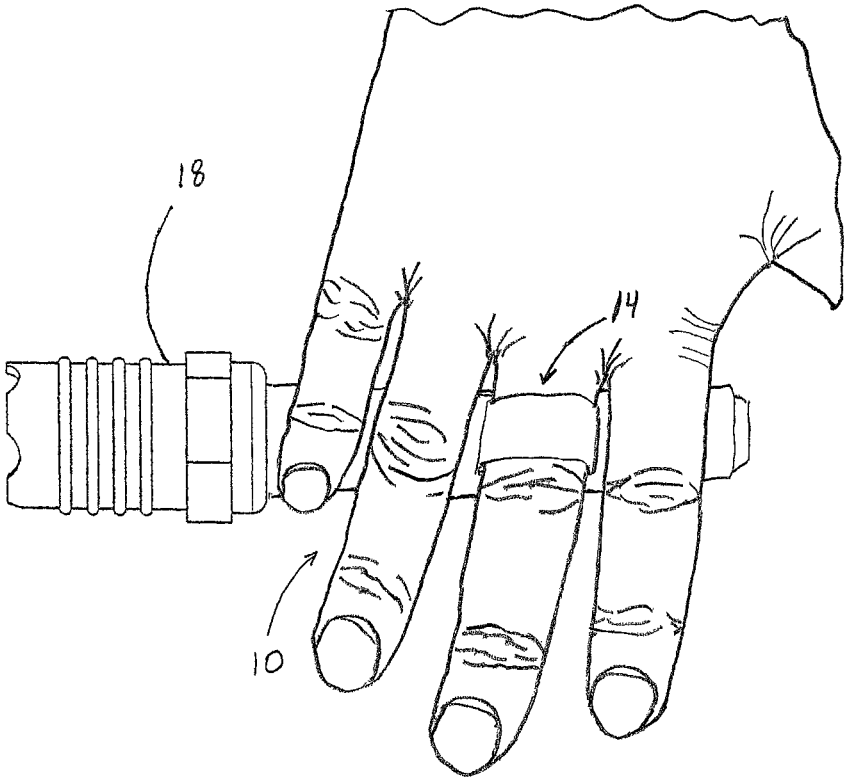
FIG. 5 is a perspective view a finger retention clip and flashlight according to the present application shown being worn by a user.

In operation, finger retention clip 10 and flashlight 18 is preferably stored or stowed in a pocket, in a pouch, on a belt, on a weapon sling, on a ladder, or anywhere else in which the user can reach clip 10 with his hand. It will be appreciated that's clip 100 functions in a similar fashion as clip 10. For purposes of this description, a pocket application will be used. The user inserts tab portion 22 into the pocket. Because retaining member 14 forms a relatively large loop, retaining member 14 extends out from the pocket. This allows the user to engage clip 10 quickly and easily by simply moving his hand toward clip 10 and allowing one or more of his fingers to slip onto the loop formed by retaining member 14. Then, the user can pull clip 10 and flashlight 18 out of the pocket, leaving flashlight 18 adjacent to the palm of the user's hand, as shown in FIG. 5. Clip 10 and flashlight 18 may be returned to the stowed position by hooking retaining member 14 inside the pocket and simply withdrawing his finger from retaining member 14.

Clip 10 is particularly useful for flashlights having control switches on the base end, as the user can easily access such switches with his thumb, while using clip 10. Clip 10 allows the user to loosen his grasp on flashlight 18 to perform other tasks with that hand, such as using other tools, climbing a ladder, operating a phone, or working with other objects, without dropping flashlight 18. In addition, because retaining member 14 forms a relatively large loop, the user can quickly and easily rotate clip 10 and flashlight 18 about his finger until flashlight 18 is adjacent the back side of the user's hand. This position gives the user unobstructed use of his hand, without having to put flashlight 18 down.

Retaining member 14 performs other functions, as well. Because retaining member 14 stands out from base member 12, retaining member 14 prevents flashlight from rolling away when flashlight 18 is placed on an inclined surface. In addition, because retaining member 14 is relatively wide, retaining member 14 allows clip 10 and flashlight 18 to stand on edge, thereby allowing the user to directly aim the light at a desired location.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

I claim:

1. A finger retention clip for retaining an object about a user's finger, comprising:

a base member adapted for attachment to the object; and a resilient retaining member attached to the base member, the retaining member forming an open finger loop and being sized and shaped to conform to the user's finger;

wherein the retaining member has a first width, and a second width narrower than the first width;

wherein the retaining member includes a structural feature that selectively provides a stress concentration, such that the retaining member releases from the user's finger in response to a selected force by breaking of the retaining member.

2. The finger retention clip according to claim 1, wherein the base member is resilient and comprises:

a longitudinal slot adapted to allow the base member to spread apart to facilitate attachment of the base member to the object;

wherein the base member is tubular.

3. The finger retention clip according to claim 1, wherein the open finger loop is configured to accommodate multiple fingers.

4. The finger retention clip according to claim 1, wherein the object is a flashlight.

5. The finger retention clip according to claim 1, wherein the retaining member comprises:

a neck portion having the first width, the neck portion attached to the base member; and an upturned tab portion having the second width.

6. The finger retention clip according to claim 5, wherein the tab portion and the neck portion are of different widths.

7. The finger retention clip according to claim 1, wherein the structural feature is a pair of notches separating the first width of the retaining member from the second width of the retaining member.

8. The finger retention clip according to claim 1, wherein the base member is releasable from the object.

9. The finger retention clip according to claim 1, wherein the base member is selectively tailored to release from the object in response to a selected force.

10. The finger retention clip according to claim 1, wherein the base member and the retaining member are made from different materials.

* * * * *